United States Patent [19]

Johnson et al.

[11] 4,301,439

[45] Nov. 17, 1981

[54] FILM TYPE RESISTOR AND METHOD OF PRODUCING SAME

[75] Inventors: Gary W. Johnson, South Norwalk; David G. Hilson, Norwalk, both of Conn.

[73] Assignee: Electro Materials Corp. of America, Mamaroneck, N.Y.

[21] Appl. No.: 972,793

[22] Filed: Dec. 26, 1978

[51] Int. Cl.[3] ..... H01C 10/00

[52] U.S. Cl. ..... 338/195; 29/620; 338/308; 338/332; 338/333; 338/334

[58] Field of Search ..... 338/195, 306-309, 338/332, 333, 334; 29/620; 427/101-103

[56] References Cited

U.S. PATENT DOCUMENTS

| | | | |
|---|---|---|---|
| 2,622,178 | 12/1952 | Glynn | 29/620 X |
| 2,694,185 | 11/1954 | Kodama | 323/74 X |
| 3,211,031 | 10/1965 | Martin | 338/195 X |
| 3,669,733 | 6/1972 | Allington | 29/620 X |
| 3,786,224 | 1/1974 | Heywang et al. | 29/620 |
| 4,032,881 | 6/1977 | Singleton | 338/195 |

FOREIGN PATENT DOCUMENTS

| | | |
|---|---|---|
| 361967 | 11/1931 | United Kingdom . |
| 1197690 | 7/1970 | United Kingdom . |
| 1367983 | 9/1974 | United Kingdom . |

*Primary Examiner*—C. L. Albritton
*Attorney, Agent, or Firm*—Amster, Rothstein & Engelberg

[57] ABSTRACT

A film type resistor especially suitable for use on planar electronic circuit substrates. The resistor is capable of being adjusted or trimmed to provide resistance values over a substantially wide range. The resistor can also be trimmed while actively functioning in a circuit including one or more other components, so as to provide a desired operating parameter for the circuit.

4 Claims, 6 Drawing Figures

FILM TYPE RESISTOR AND METHOD OF PRODUCING SAME

DESCRIPTION OF THE INVENTION

The present invention relates generally to film type resistors, and more particularly to a trimmable planar film resistor configuration which can be set or actively trimmed to a desired value over an unusually wide span of resistance values.

Resistors in the form of a relatively thin film of resistive material deposited between a pair of electrical terminals are well known in the art. These resistors typically include a metallic or metal oxide type film which, when deposited in a given thickness on a non-conductive glass or ceramic substrate, provides a known electrical resistivity. This resistivity is usually measured in terms of ohms per square unit of film surface area, and is commonly referred to as a certain number of "ohms per square." A pair of terminals are connected with the film at spaced apart, respective locations on the film surface. The actual resistance value obtained is then determined by the product of the resistivity of the film, and the square units of film surface area which define a resistive path between the terminals. Resistors of this type are known to be constructed on both flat and cylindrical substrates.

Methods for trimming or otherwise adjusting the resistance obtained from film resistors of cylindrical construction are also known, examples appearing in U.S. Pat. Nos. 3,534,472 and 3,675,317. In the methods of both these patents, a helical groove is cut through the film down to the cylindrical substrate core, so as to define a helical rather than a direct resistive path through the film between the terminals. This helical path is longer, i.e., consisting of a greater number of square units than exists before the groove is cut, and thus has the effect of presenting an increased resistance between the terminals over that originally provided by the film. Since these methods usually require that the cylindrical core be rotated about its axis as the helical groove is being cut through the film, it is difficult if not impossible to trim resistors of this type after they are physically wired or otherwise connected in an electrical circuit. This drawback can be serious when a precise resistance value must be supplied in order to achieve desired circuit performance.

As a result of an increasing demand for electronic and radio equipment incorporating printed circuitry on flat boards or substrates, rather than point-to-point hand wiring, circuit components have been developed to be particularly compatible with printed circuit and other planar wiring arrangements now used. For example, U.S. Pat. No. 3,722,085 shows a planar resistor in which a film of resistive material is overprinted on concentric terminal conducting rings so as to provide a particular film resistance value between the ring terminals. Further, the '085 patent discloses the uniform abrasion of the film in order to obtain a desired film resistance. A maximum gain in resistance in the order of about 16 is obtainable, according to the abrasion technique of the patent.

Another known configuration, in which a resistive film can be trimmed to yield a desired value in a planar circuit arrangement includes a block of resistive film material located between the ends of a pair of conductive terminals so as to resemble a "top hat," with the terminals defining the hat brim. Removing the film material progressively from the bottom of the "top hat" increases the effective length of the current path through the material between the terminals. In typical applications, up to about a 10 to 1 increase over the original film resistance can be obtained with this type of configuration. Up to now, however, no known planar film resistor has been developed which can be trimmed to provide a substantially greater gain in resistance as a result of removing part of the film material after it is placed on a non-conductive substrate.

It is an object of the present invention to overcome the above and other shortcomings in prior art film resistors.

It is another object of the present invention to provide a film resistor which is especially suitable for planar circuit applications.

It is yet another object of the present invention to provide a planar film resistor which can be trimmed to provide a substantially high gain over its original resistance value.

It is a further object of the present invention to provide a planar film resistor which is capable of being trimmed over a wide range of resistance values while occupying a relatively small substrate area.

It is still another object of the present invention to provide a planar film resistor which can be layered above one or more other planar circuit components, and then actively trimmed to provide a desired circuit parameter.

It is a still further object of the present invention to provide a film resistor configuration which permits a number of additional circuit components to occupy a given area therewith over a planar substrate.

In accordance with the present invention, a method of obtaining a desired resistance between two locations on a layer of resistive material includes the step of removing the material from the layer over a convoluted path which surrounds one of the locations to define a resistive path of sufficient length along the layer to obtain the desired resistance.

A resistor in accordance with the present invention includes a planar substrate, a layer of resistive material supported on the substrate, and a pair of terminals on the substrate coupled to the resistive layer at respective terminal areas, the resistive material being removed from the layer over a convoluted path which surrounds one of the terminal areas to define a resistive path along the layer of sufficient length to obtain a desired resistance between the terminals.

The above brief description, as well as further objects, features and advantages of the present invention, will be more fully understood by reference to the following detailed description of a presently preferred, but nonetheless illustrative embodiment in accordance with the present invention, when taken in conjuction with the accompanying drawings, wherein.

Figure 2:
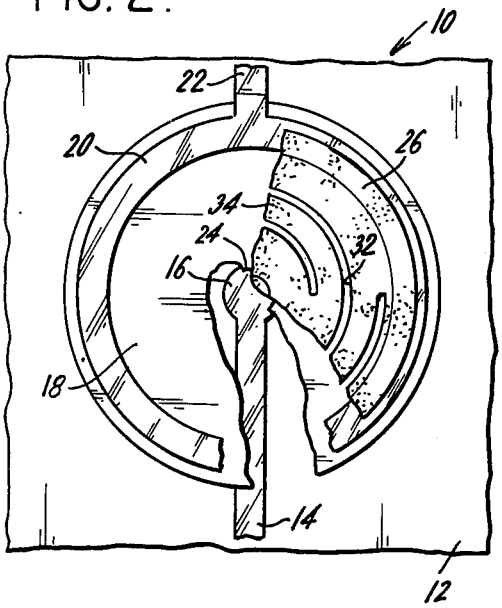
FIG. 2 is plan view of the resistor as in FIG. 1, showing component layers of the resistor with pieces broken away for purposes of illustration.
Figure 1:
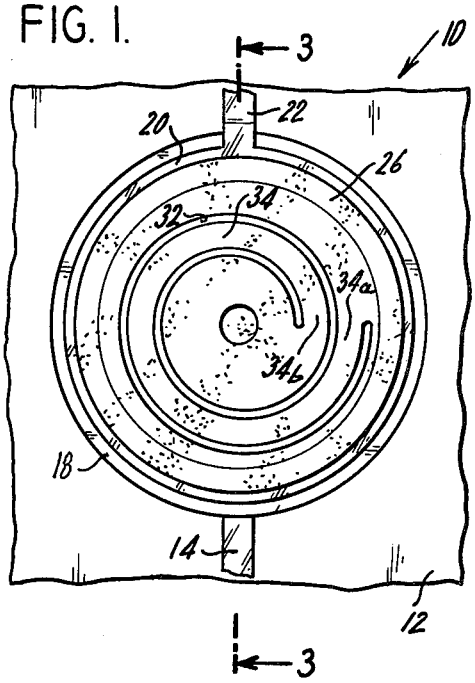
FIG. 1 is a plan view of a resistor in accordance with the present invention, showing the resistor configured on a planar substrate.
Figure 3:
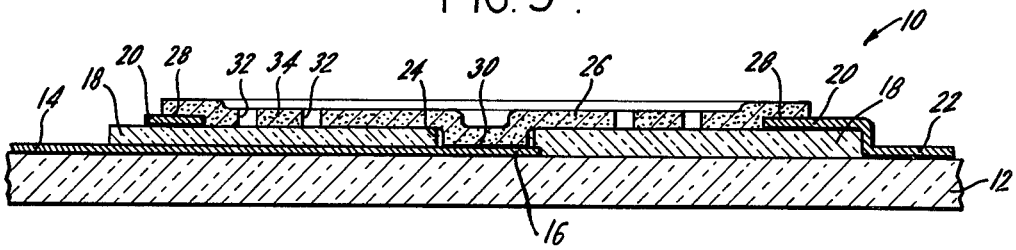
FIG. 3 is a cross-sectional elevational view of the resistor of the present invention and showing its component layers, as taken substantially along line 3—3 of FIG. 1 and looking in the direction of the arrows.

Referring now in detail to the drawings, and initially to FIGS. 1 to 3 thereof, there is provided a resistor in accordance with the present invention, the resistor being generally designated by the reference numeral 10. Basically, the resistor 10 is formed on a planar substrate of insulative material 12, such as a conventional printed circuit board of plastic or ceramic material including but not limited to alumina or beryllia. The substrate 12 may well include a number of other electronic circuit components (not shown) with which the resistor 10 is to be interconnected by strip conductors printed on the substrate.

As more clearly shown in FIG. 2, substrate 12 has a conductive metallic strip 14 provided thereon, the strip 14 including an enlarged terminal 16 at one end. Strip 14 may be of gold, copper, aluminum or other material of like conductivity which can be easily formed on the substrate 12 by well known thick or thin film techniques. For example, strip 14 may be screen printed to a thickness of about 10 to 20 microns, or be vacuum deposited or etched to a lesser thickness if desired.

A layer of insulative dielectric material 18 is provided on the substrate 12 so as to overlie the strip 14. A second terminal 20 is located on top of the layer 18, terminal 20 being in ring form and encircling the end terminal 16 of strip 14 as viewed from above. Terminal 20 connects with a strip conductor 22 which extends therefrom over the edge of the dielectric layer 18 and onto the surface of substrate 12 to connect with other components or terminals on the substrate. The thickness of the dielectric layer 18 should be sufficient to withstand voltages which will appear across the terminal strip 14 and terminal ring 20 when the resistor 10 is in operation.

An opening 24 is provided in the dielectric layer 18 in registration with the end terminal 16. Opening 24 is thus centrally located within the area enclosed by the ring terminal 20 on the top surface of layer 18.

As best shown in FIG. 3, a resistive film layer 26 is placed over the dielectric layer 18 so that a given area of the layer 26 is in electrical contact with the terminal ring 20, as at 28. Also, another area of the resistive layer 26 electrically contacts the end terminal 16 in the vicinity of the opening 24, as at 30. Layer 26 may comprise either thick or thin film resistive materials. Suitable thick film compositions include but are not limited to mixtures of glass and metal or metal oxide powders. Suitable metal powders include platinum, gold, palladium, ruthenium, iridium, nickel, copper, and alloys or mixtures thereof. The particular metallic ingredient or ingredients, and the ratio of the glass and metal or metal oxide powders in the composition, would depend upon the desired resistivity of the layer 26, and can be readily determined by one skilled in the art.

For example, a suitable film composition for layer 26 which will exhibit about 1,000 ohms per square per mil of thickness, when fired dry, comprises a finely divided powder mixture of 90% lead borosilicate glass and 10% ruthenium dioxide. Layer 26 can then be screen printed or otherwise applied on the dielectric layer 18 in accordance with well-known thick film techniques. Similarly, suitable thin film materials for the layer 26 include but are not limited to nichrome or tantalum nitride, these materials being suited for deposition on the dielectric layer 18 by evaporative processes in accordance with conventional thin film technology.

It will be understood that in accordance with the above construction, the resistive layer 26 will provide a particular resistance between the terminals 16 and 20. This resistance depends upon the particular composition of the resistive material used and its layer thickness which together determine its resistivity, and the overall surface area of the layer 26 enclosed between the areas contacted by the terminals 16 and 20.

In many applications, however, it may be required to establish a precise resistance value in order to obtain one or more desired network parameters, such as a particular gain or frequency response for a circuit network of which the resistor 10 is a component part. Most networks, when constructed in planar form such as on the substrate 12, usually contain other components whose values cannot be adjusted over a substantially wide range, e.g., film capacitors or inductors. It then becomes necessary to vary or trim the resistance provided by the resistor 10, while monitoring the network during its operation to observe when the desired parameters are obtained. This is often referred to as "active trimming."

In accordance with the present invention, the resistor 10 is especially suited to be actively trimmed. Specifically, the resistive layer 26 has a groove 32 cut therein so that the effective number of square units of resistive material between the terminals 16 and 20 is increased over that originally provided by the material of layer 26. The groove 32 is cut by laser techniques well-known to those skilled in the art, the laser beam being directed against the layer 26 and moved over a particular path relative to the resistor 10. Of course, other conventional methods of removing the layer 26 to form the groove 32 therein may be used, provided the path of removal can be made as narrow as desired and be guided over the layer with sufficient accuracy.

Trimming of the resistor 10 is carried out by removing the resistive material from the layer 26 over a convoluted path which surrounds the area contacted by the terminal 16, this path of removal being shown in FIGS. 1–3 in the form of the spiral groove 32 which extends between the terminals 16 and 20. It can be seen that groove 32 defines a convoluted resistive path 34 in the layer 26 which likewise extends spirally between path ends **34*a* and 34*b* (FIG. 1). The groove 32 is formed to be of length so that resistive path 34 comprises a sufficient square unit area or number of "squares" of resistive material to provide the desired resistance value between terminals 16 and 20. Accordingly, trimming of the resistor 10 can be performed by progressively cutting the convoluted groove 32 to define a corresponding resistive path of increasing length, until a desired resistance is monitored between the terminals 16, 20, or a desired network parameter is achieved while a circuit network of which resistor 10 is a part is in operation. Of course, the width of the final resistive path 34 should be maintained at a minimum predetermined value between 34*a* and 34*b*, to enable the resistor 10** to operate properly without current induced overheating.

It should also be noted that due to the occurrence of what are believed to be heat induced stresses in the resistive layer 26 as it is trimmed, the resistance provided between the terminals 16, 20 may drift soon after the end of a trimming operation. For example, after laser trimming is terminated, some resistance drift may be detected for as long as 15 minutes. Also, drift may later be experienced if the layer 26 is subjected to an elevated temperature, such as 150° C. for purposes of stress relief, and then allowed to cool. Therefore, depending upon the direction and magnitude of the expected drift, which can be closely estimated in a well known manner, the trimming operation should be terminated either before or after the desired final value of resistance or operating parameter is attained. This will allow the resistor to drift toward and provide the desired value in a steady state.

Figure 5:
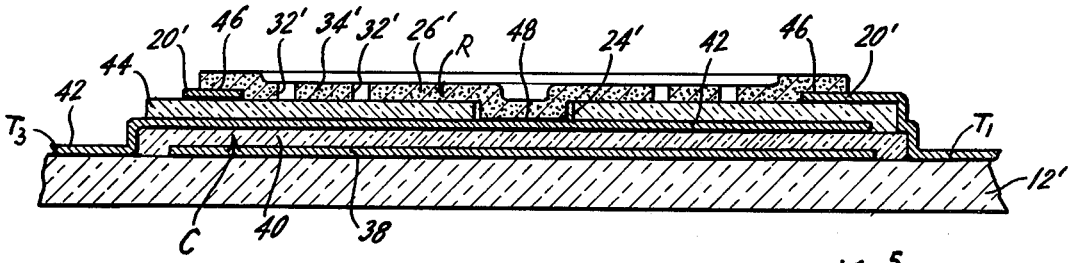
FIG. 5 is a cross-sectional elevational view of the resistor and capacitor of FIG. 4 and showing their component layers as taken substantially along line 5—5 of FIG. 4 and looking in the direction of the arrows.
Figure 6:
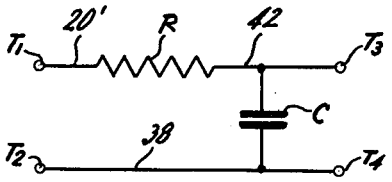
FIG. 6 is an electrical schematic diagram of a circuit established between sets of terminals associated with the resistor-capacitor configuration of FIGS. 4 and 5.
Figure 4:
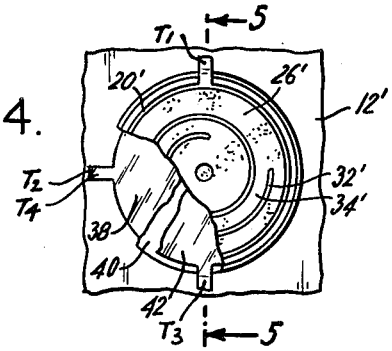
FIG. 4 is a plan view of the resistor and of a capacitor configured on a planar substrate in accordance with the present invention, showing component layers with pieces broken away for purposes of illustration.

Referring now to FIGS. 4 and 5, the film resistor of the present invention is shown integrally formed and connected with a film capacitor C to provide a conventional R-C low pass filter network as in FIG. 6. Capacitor C is formed on a substrate 12' of insulative material having a conductive disc 38 thereon which serves as one electrode of capacitor C. On top of the disc 38 is a dielectric layer 40 for performing the charge storage function for the capacitor. The composition and thickness of the layer 40 will therefore depend on the desired capacitance to be obtained, the surface area of the disc 38 and the voltage to be applied across the capacitor C, as is well known to those skilled in the art.

Another conductive disc 42 is then provided on top of dielectric layer 40, the disc 42 serving as the other electrode of the capacitor C, and one of the two terminals of resistor R. An insulative layer 44 is placed on top of the disc 42, the layer 44 having an opening 24' therein which overlies the disc 42 as shown in FIG. 5. A conductive ring terminal 20' is then located on top of the dielectric layer 44 so that the opening 24' through layer 44 is centrally located within the area enclosed by the terminal 20'. Further, a resistive layer 26' is placed over the dielectric layer 44, including at least a portion of the ring terminal 20' so that terminal 20' contacts a given area of the resistive layer, as at 46. Another area portion of the layer 26° makes contact with the center of the disc 42 in the vicinity of the opening 24', at 48. In accordance with this construction, the filter network of FIG. 6 is realized in a planar configuration, with terminals T1–T4 which are also identified in FIGS. 4 and 5.

The resistance provided by resistor R between the terminals T1 and T3 can then be actively trimmed to provide a desired circuit parameter for the network of FIG. 6. For example, the amplitude of a signal provided across output terminals T3–T4 can be monitored while a known signal of given amplitude and frequency is applied across input terminals T1–T2. In accordance with the present invention, a convoluted groove 32' (FIGS. 4 and 5) is progressively cut into the surface of the resistive layer 26' in the same manner as in the embodiment of FIGS. 1–3, until the monitored parameter reaches a predetermined value. The trimming operation can then be terminated to allow resistor R to drift to a final value so that the desired parameter is obtained when the resistive layer cools to ambient temperature.

The present invention provides a resistor in planar form of relatively small dimensions which can be trimmed by known techniques to provide a substantially wide range of resistance values. For example, it can be shown that a resistive layer of about 0.480 inches (1.22 cm) diameter can theoretically be trimmed in accordance with the present invention to yield a gain in resistance of about 400 times the original value while maintaining a width of 0.040 inches (1.02 mm) for the resistive path 34 (or 34') through the layer. Reducing this width to 0.020 inches (0.52 mm) results in a theoretical fourfold increase of obtainable resistance gain to about 1600 times the original value, these gains being accomplished in less than 0.25 square inches (1.61 sq. cm) of area on the resistive layer. Also, the ability of the present film resistor configuration to be integrally formed with other planar circuit components allows for a single network design which can be later adjusted to provide a variety of operating parameters, depending upon the system in which it is incorporated. This allows for stocking of only a relatively few different basic network configurations, which can then later be actively trimmed when placed in use. This, in turn, leads to lower manufacturing costs.

As will readily be apparent to those skilled in the art, the present invention may be realized in other specific forms without departing from its spirit or essential characteristics. The present embodiments are, therefore, to be considered as illustrative and not restrictive, the scope of the invention being indicated by the claims rather than by the foregoing description, and all changes which come within the meaning and range of equivalents of the claims are therefore intended to be embraced therein.

What is claimed is:

1. A resistor adapted to be integrally formed with at least one other electrical network component on a planar substrate, said resistor comprising a first conductive terminal coupled to said at least one other component, a second conductive terminal, a first layer of insulative material intermediate said first and second terminals for supporting said second terminal, said first layer having an opening therein overlaying said first terminal, and a second layer of resistive material extending over said first layer, said resistive material being coupled to said first terminal through said opening thereby defining a first terminal area on said second layer, and to said second terminal thereby defining a second terminal area on said second layer, wherein a desired network parameter is obtained when said resistive material is removed from said second layer over a convoluted path surrounding said first terminal area to define a corresponding resistive path of sufficient length along said second layer to obtain said desired parameter.

2. A resistor as defined in claim 1, wherein said second terminal area defines a substantially closed path about said first terminal area, and at least a portion of said resistive path extends spirally between said first and second terminal areas.

3. A resistor comprising a planar substrate, a layer of resistive material, an insulative layer disposed between said substrate and said layer of resistive material, and a pair of conductive terminals disposed adjacent the top and bottom of said insulative layer, respectively, said terminals being coupled to said resistive material at respective terminal areas on said resistive layer, said resistive layer having said resistive material removed therefrom over a convoluted path surrounding one of said terminal areas to define a corresponding resistive path of sufficient length along said layer to obtain a particular resistance between said pair of terminals.

4. A resistor as defined in claim 3, wherein one of the terminal areas on said layer of resistive material defines a substantially closed path about the other terminal area, and at least a portion of said resistive path extends spirally between said terminal areas.

* * * * *